US005504972A

United States Patent [19]

Tada et al.

[11] Patent Number: 5,504,972

[45] Date of Patent: Apr. 9, 1996

[54] METHOD AND APPARATUS FOR REMOVING DEPOSITS ADHERING ON MATERIALS

[75] Inventors: Hiroshi Tada; Yoshitaka Koishi; Yorinobu Takino, all of Hirakata; Matsui Osamu, Osaka; Kiyoshi Morimoto, Mishima; Yoshika Sanada, Shizuoka; Teiichi Miwa, Mishima; Kazue Murata, Hirakata, all of Japan

[73] Assignees: Matsui Manufacturing Co., Ltd., Osaka; Kyowa Hakko Kogyo Co., Ltd., Tokyo, both of Japan

[21] Appl. No.: 60,724

[22] Filed: May 12, 1993

[30] Foreign Application Priority Data

May 12, 1992 [JP] Japan ..... 4-165234

[51] Int. Cl.[6] ..... A47L 5/05

[52] U.S. Cl. ..... 15/404; 15/309.2; 209/468

[58] Field of Search ..... 15/404, 306.1, 15/303, 309.2; 209/475, 468

[56] References Cited

U.S. PATENT DOCUMENTS

| | | | |
|---|---|---|---|
| 693,455 | 2/1902 | Stanley | 15/308 |
| 2,200,472 | 5/1940 | Erdman | 209/475 X |
| 2,425,984 | 8/1947 | Blackman . | |
| 2,512,422 | 6/1950 | Fletcher et al. | 209/475 |
| 2,617,137 | 11/1952 | Bodnar | 15/308 |
| 2,903,132 | 9/1959 | Berry | 209/475 |
| 2,918,691 | 12/1959 | Lake | 15/308 |
| 3,096,532 | 7/1963 | Frank | 15/308 X |
| 3,166,004 | 1/1965 | Fries | 15/309.2 |
| 3,804,250 | 4/1974 | Dankesreiter | 209/475 |
| 4,198,725 | 4/1980 | Trutzschler | 15/309.2 |

FOREIGN PATENT DOCUMENTS

| | | | |
|---|---|---|---|
| 1297944 | 3/1987 | U.S.S.R. | 209/468 |

*Primary Examiner*—Frankie L. Stinson
*Attorney, Agent, or Firm*—Koda and Androlia

[57] ABSTRACT

The present invention discloses a method and an apparatus for removing deposits from materials. By feeding unidirectional pulsating air pulsating while flowing in one direction, porous member (4), to materials (m) supplied from above the porous member (4) stretched laterally in a main body case (1A) of a removing apparatus main body (1), the deposits from the materials (m) are removed by the action of the unidirectional pulsating air. The apparatus comprises a removing apparatus main body (1) possessing a feed port (5) and a product outlet (11) disposed above a porous member (4) stretched laterally in a main body case (1A), and an air vibration generating device (30) for feeding unidirectional pulsating air pulsating while flowing in one direction, toward the porous member (4) from above the porous member (4).

3 Claims, 8 Drawing Sheets

METHOD AND APPARATUS FOR REMOVING DEPOSITS ADHERING ON MATERIALS

BACKGROUND OF THE INVENTION

1. Field of the Invention

The present invention relates to method and apparatus for removing deposits to be applicable widely in industries in which it is necessary to remove dusts or other deposits from powdered or granular materials such as tablets, remove foreign matter adhering on the surface of semiconductor products, or remove dusts or other deposits from other materials. The invention may be also applied as the method and apparatus for classifying by sifting powdered or granular materials.

2. Prior Art

Hitherto, as the method for sifting powdered or granular materials capable of removing deposits from materials, the Japanese Patent Publication Sho. 52-10538 is known. This publication discloses what is shown in FIG. 10, which is designed to sift powdered or granular materials by using pulsating air.

The constitution in FIG. 10 is explained below. An exhaust port 501 and a takeout port 502 are provided in upper and lower parts of a hopper-shaped casing 500, and a sieve mesh 503 is stretched horizontally in the casing 500, and pulsating air or non-pulsating air flow is sent to a material layer 504 above the sieve mesh 503 from an air pipe 505 opened downward of the sieve mesh 503 to fluidize the powdered or granular materials on the sieve mesh 503, so that the materials of specified particle size may be sifted. That is, the takeout port 502 communicates with a proper exhaust device or separating device in next step, for example, cyclone device, and the air is sucked out in the direction of arrow a, and therefore the powdered or granular materials on the sieve mesh 503 are fluidized by the vertical reciprocal air flow continuously as indicated by arrow b as cooperating action with pulsating air by the air pipe 505.

In short, in this prior art, by the cooperating action of the air flow from the air pipe 505 toward the material layer 504 and the downward air flow from the takeout port 502, the pulsating waves (arrow b) reciprocating vertically on the material layer 504 above the sieve mesh 503 act to effect classifying action.

Therefore, in the prior art, in order to fluidize the material layer 504 on the sieve mesh 503 by the vertical reciprocal air flow b (plus and minus method), the air flow from the air pipe 505 must be actuated by a considerably large energy, and hence the noise increases. To suppress the noise, the casing 500 must be put in a case made of soundproof wall such as concrete. It hence requires a special soundproof case, and it is not practical.

The invention is devised in order to solve these problems, and presents a method capable of removing deposits from materials by applying air vibrations, and an apparatus for realizing such method.

SUMMARY OF THE INVENTION

It is hence a primary object of the invention to present a method and apparatus for removing deposits adhering on materials by fluidizing the deposits to be removed with a pulsating air in one direction, without fluidizing with vertical reciprocating air flow as in the prior art, thereby requiring smaller energy, releasing less noise than in the prior art, and enhancing the practical value without damaging the materials themselves.

It is another object of the present invention to present a method and apparatus for removing deposits wherein both the material and the porous members are made to vibrate because a plural number of porous members disposed laterally in stairs in opposite directions alternately in the main body case of cylindrical form are designed to vibrate with unidirectional pulsating air. This increases the impact force among the particles of the material and facilitates separation and peeling of the deposits adhering to the material, thus not only improving the deposit removing capacity but also ensuring uniform removal and preventing clogging of the porous members.

It is another object of the present invention to provide a method and apparatus for removing deposits wherein the inside of the empty compartment of the main body case is provided with a pulsating wave of suction air from above and the suction air acts on the entire area of the material on the porous members without producing any drift in itself thereby making it possible to remove deposits from the material more uniformly and effectively in combination with the vibrating action of the porous members and the material itself with unidirectional pulsating air.

Moreover, since the present invention is designed to remove deposits from the material by means of a pulsating wave of suction, it is another object of the present invention to provide a method and apparatus for removing deposits which does not cause any flying of dust nor require any sealing and reduces the number of parts as a result of the simple construction and absence of mechanical drive system and is easy to maintain.

It is other object of the invention to present a method and apparatus for removing deposits efficiently, capable of freely adjusting the peeling force for removing deposits adhering on materials, by changing the waveform of pulsating waves in one direction to be supplied to the materials to be treated, and and treating flexibly depending on the state of deposits.

It is another object of the invention to present a method and apparatus, capable of performing automatically in a series of operations from removal of deposits adhering on materials till discarding, by taking out the deposits removed from the materials by pulsating air in one direction from the main body of the apparatus for removing.

Other objects, features and benefits of the invention will be clarified and appreciated well in the following description.

To achieve these objects, the method of the invention is characterized by feeding unidirectional pulsating air pulsating while flowing in one direction, either from above or from below a porous member, to materials supplied from above the porous member disposed laterally in the main body case of the main body of removing apparatus, and removing the deposits from the materials by the action of the unidirectional pulsating air. The deposits removed in this method are discharged from the main body of the removing apparatus, and the materials being rid of the deposits are taken out from a product outlet.

In this method, the waveform of the unidirectional pulsating wave is arbitrarily changed. As a result, the force (peeling force) for removing the deposits such as dusts adhering on materials can be freely adjusted and set.

As the apparatus for realizing this method, the invention provides an apparatus for removing deposits comprising a plural number of porous members disposed laterally in stairs in opposite directions alternately in a main body case formed in a cylindrical shape, a feed port for a product provided above the porous member at the top, a removing apparatus main body having a product outlet provided at a lower part, and an air vibration generating device for feeding unidirectional pulsating air flowing in one direction toward the porous members from above and the porous members are designed to vibrate with the unidirectional pulsating air.

The unidirectional pulsating wave by the air vibration generating device is obtained chiefly by vibrating the sound waves in low frequency or medium frequency band, including inaudible sound waves with air, nitrogen or other gas, and its waveform is generally obtained as pulse wave or sine wave, but the waveforms of the invention may be freely varied as far as belonging the minus (–) region, supposing the upper part from the baseline (atmospheric pressure) to be the plus (+) region and the lower part as the minus (–) region.

The air vibration generating device comprises an air source for generating air or gas such as ring blower, Roots blower and vacuum pump, an oscillating device for vibrating the air from the air source, and a waveguide for leading the air vibration from the oscillating device to the removing apparatus main body. However, the air vibration generating device is not limited to this constitution alone, and for example, the suction port or exhaust port of the air source such as blower is connected to the removing apparatus main body with the waveguide, and a valve is provided on the way of the waveguide, and the duct of the waveguide is opened and closed intermittently by this valve, thereby feeding the unidirectional pulsating air toward the porous member in the removing apparatus main body. Or, by a reciprocating air compressor and a pressure air changeover device, air vibrations may be generated, or it may be composed of air source and rotor type changeover valve, and any other arbitrary constitutions may be possible.

The air source is the suction type may be employed, and the air vibration waves are repeated only in the minus region toward the porous member.

In the apparatus, the waveforms of the air pulsating wave supplied from the air vibration generating device are variable.

The material supplied on the porous member is turned upside-down and fluidized by the unidirectional pulsating air, and classified into desired particle size, that is, the deposits and products are separated. At this time, it may be hard to convey the products being rid of deposits efficiently into the discharge direction by the force of the unidirectional pulsating air. Considering such situation, the porous member may be inclined in a down slope to the feed direction of material or the porous member may be vibrated and thus a force for advancing the material on the porous member is provided.

The removing apparatus main body is furnished with deposit takeout means.

The gas for applying gas vibration is mainly air in the invention, but not limited to air alone, other gases such as ionized air (for example, ozone) and inert gas may be included. Instead of one porous member, plural porous members may be provided in stairs in a tubular empty compartment by forming the main body case in a tubular form.

DETAILED DESCRIPTION OF THE INVENTION

Referring now to FIG. 1 through FIG. 4, a first embodiment of an apparatus for removing deposits and a method for removing deposits of the invention is described in detail below.

Figure 1:
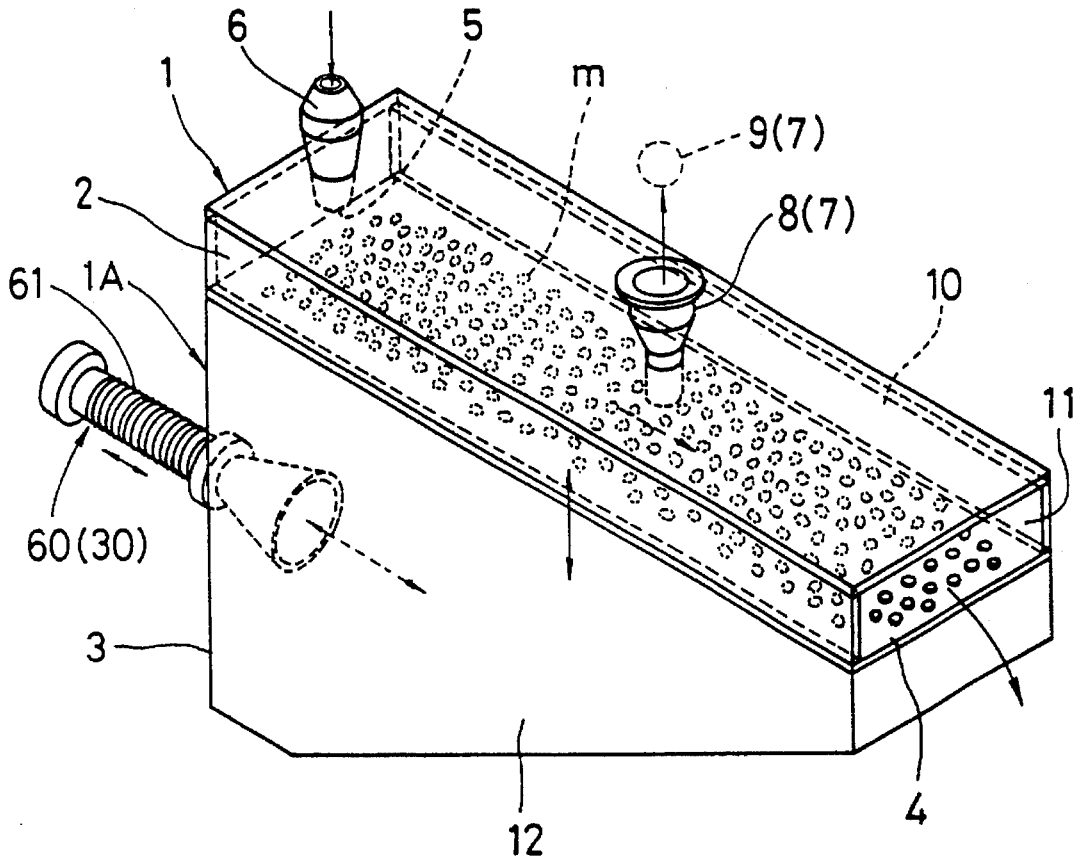
FIG. 1 is a perspective view of a removing apparatus main body in a first embodiment of the invention.
Figure 2:
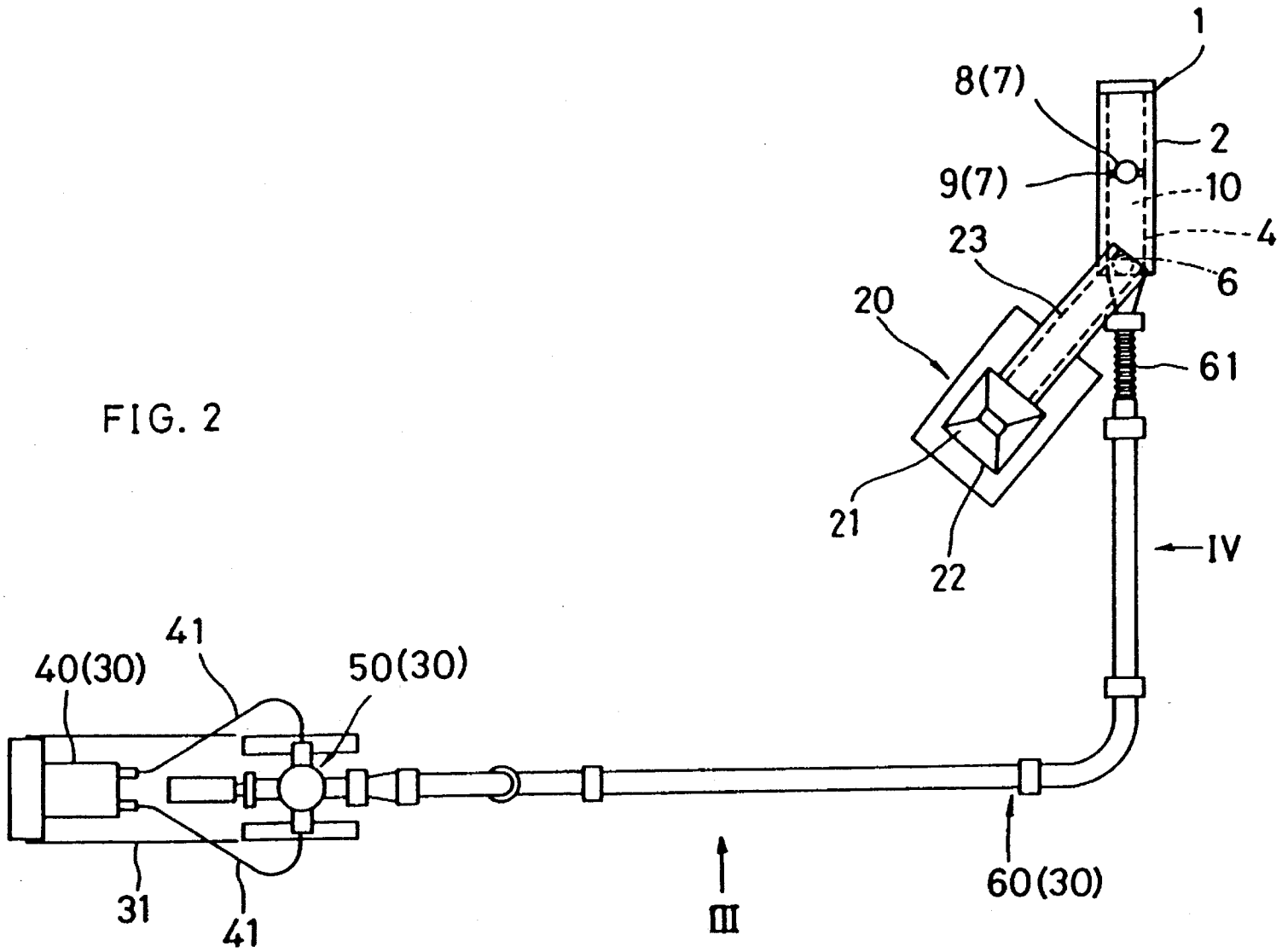
FIG. 2 is a plan showing the entire apparatus for removing deposits.
Figure 3:
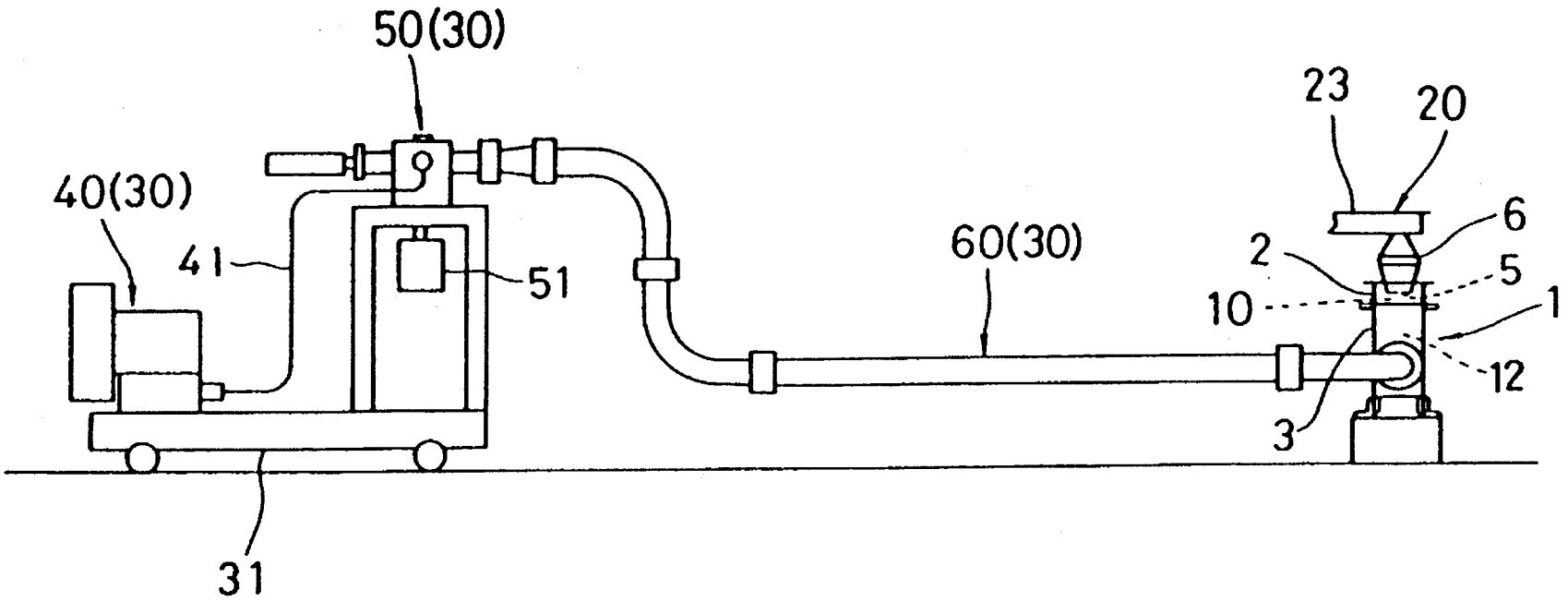
FIG. 3 is an arrow view in direction III.
Figure 4:
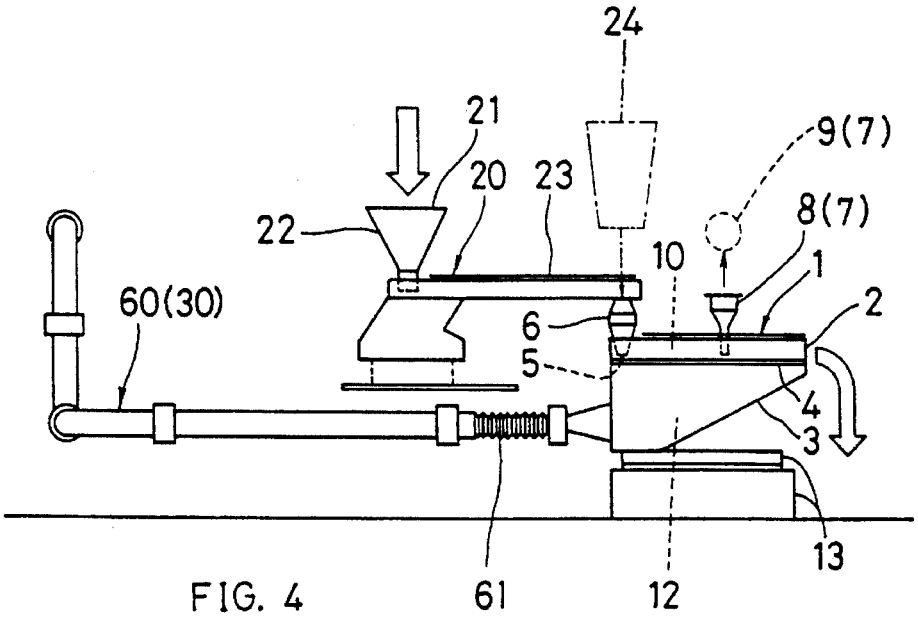
FIG. 4 is an arrow view in direction IV.

FIG. 1 is a perspective view of a removing apparatus main body 1 which is the key part of the apparatus for removing deposits according to the invention, and FIG. 2 through FIG. 4 show the entire apparatus for removing deposits including the removing apparatus main body 1, FIG. 2 being a plan, FIG. 3 being an arrow view in direction III, and FIG. 4 being an arrow view in direction IV. The removing apparatus main body 1 comprises a main body case 1A, and the main body case 1A consists of an upper part 2 and a lower part 3. The upper part 2 and lower part 3 are partitioned by a porous member 4 which is a punching plate (or mesh plate) laterally stretched in the main body case 1A. The upper part 2 has an upper lid, and is flat in the shape of solid, and a feed tube 6 of which one end is a feed port 5 of materials, or tablets m in this case, is inserted, and a dust removal tube 8 which is a part of deposit takeout means 7 is inserted and fixed nearly in the center of the upper lid. A suction blower 9 for composing the deposit takeout means 7 is connected to the dust removal tube 8. An upper space 10 which is a free space in the upper part 2 is open in one direction, and this opening is a product outlet 11. The product outlet 11 may be directly combined with a product container, a container through a chute, or a conveyor.

The lower part 3 possesses an enclosed lower space 12 formed in an upward slope in the direction of the product outlet 11. The porous member 4 is slightly inclined downward in the direction of the product outlet 11, and the lower part is supported by a frame 13. The inclination angle of the porous member 4 is determined in consideration of the angle of repose for materials m to slide down, retention time required for fluidization of materials m, and others.

One the porous member 4 of the removing apparatus main body 1, materials, or tablets m are sequentially supplied through the feed tube by a vibration type tablet feeder 20. This feeder 20 is provided with a hopper 22 possessing an inlet 21, and tablets m from the hopper 22 are supplied onto the porous member 4 in the upper space 10 of the removing apparatus main body 1 from within the feed tube 6 by the mechanical vibration through a feeder main body 23.

As the feeding method of materials m into the feed tube 6, without using the tablet feeder 20, that is, hopper 22 and feeder main body 23, it may be also possible to feed, as indicated by virtual line in FIG. 4, feed from a feed source such as tableting machine 24 directly into the feed tube 6.

An air vibration generating device 30 for supplying unidirectional pulsating air pulsating while flowing in one direction toward the porous member 4 from beneath the porous member 4 comprises, in this embodiment, an air source 40, an oscillating device 50, and a waveguide 60. The air source 40 is a ring blower type, but it may be also of Roots blower, vacuum pump, or other type. Air is supplied from the air source 40 to the oscillating device 50 through a tube 41. The oscillating device 50 is of rotary type, and the sound waves in low frequency or medium frequency band can be changed to pulse waves, sine waves or other waveforms as air vibrations. This change can be done by an inverter 51, and the amplitude and other factors of waveforms can be changed. The air source 40 and oscillating device 50 are mounted on a movable frame 31. The oscillating device 50 may be of, aside from rotary type, bellows type, engine type, or the like.

The removing apparatus main body 1 and air vibration generating device 30 are installed separately from each other, and the pulsating air from the air vibration generating device 30 is supplied to the removing apparatus main body 1 through a waveguide 60.

The waveguide 60 is connected to the lower space 12, and a flexible tube 61 adjustable in length is placed at its terminal end. The flexible tube 61 possesses, by adjusting its length, the function for maximizing the energy of air vibration in the removing apparatus main body 1 in response to the wavelength of air vibration.

The operation of the apparatus for removing deposits shown in the embodiment herein is described below by reference to FIGS. 1 to 4.

Material tablets m powdered with dusts being sent forth from the tablet feeder 20 by vibration are sequentially supplied in the upstream on the porous member 4 of the removing apparatus main body 1 through the feed port 5. The air vibration pulsating while flowing in one direction generated from the air source 40 through the oscillating device 50 acts on the lower space 12 from the waveguide 60, and passes through the pores of the porous member 4 to be applied to the tablets m on the porous member 4. The material tablets m receive air vibrations, and vibrated, for example, either in positive or negative polarity, and turned upside-down, and fluidizing, and the vibrating air acts on the surfaces as if hammering, and dust and powder deposits are shaken off. This action is applied to the smallest parts everywhere, and deposits of dust and foreign matter are efficiently removed from the tablets to be treated, and the noise level is lower than in the prior art. The removed deposits are discharged out of the system by the suction blower 9. The air vibration functions effectively for transfer of tablets m, together with the inclination of the porous member 4.

Referring also to FIGS. 1 to 4, the method for removing deposits of the invention is explained below.

For the materials m supplied from above the porous member 4 stretched laterally in the main body case 1A of the removing apparatus main body 1, unidirectional pulsating air pulsating while flowing in one direction is generated in other place. The unidirectional pulsating air is supplied from one direction, either above or below the porous member 4 through the waveguide 60, and deposits are removed from the materials m by the action of the unidirectional pulsating air.

Figure 5:
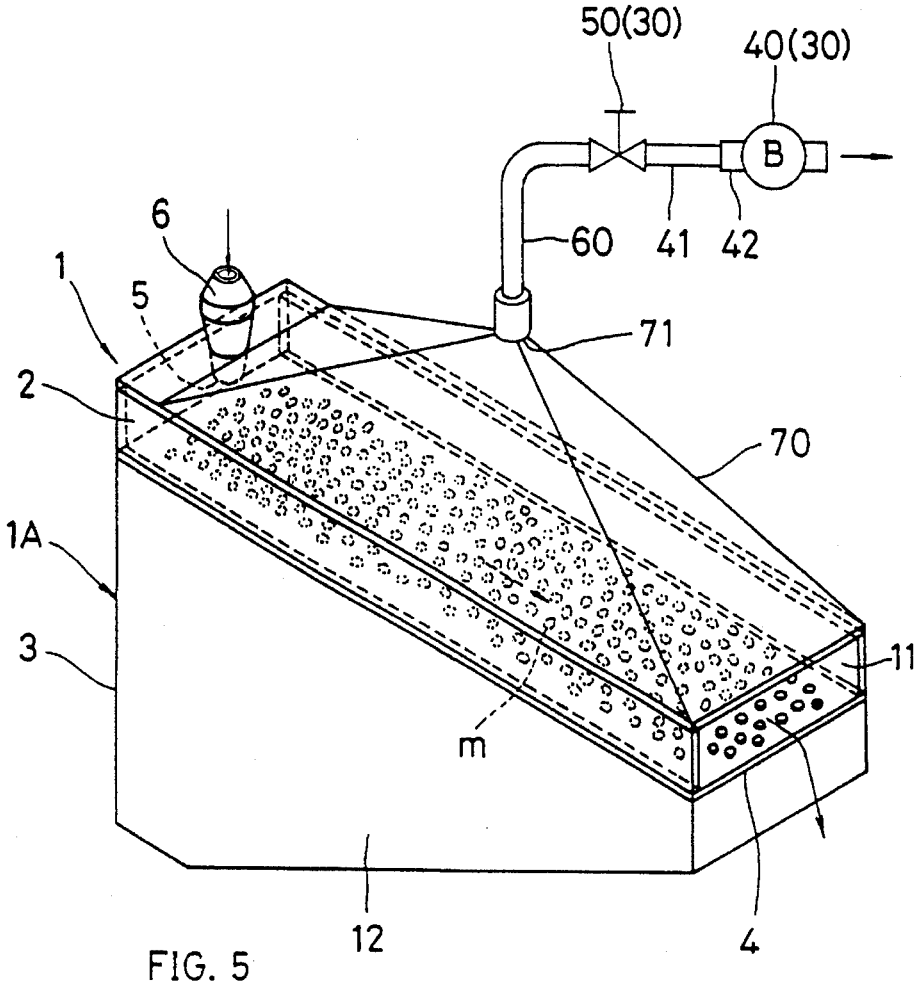
FIG. 5 is a perspective view of a removing apparatus main body in a second embodiment of the invention.

FIG. 5 relates to a second embodiment of the invention.

This embodiment is notably different from the preceding embodiment in that the unidirectional pulsating air from the air vibration generating device 30 is supplied from above the porous member 4, and that the oscillating device 50 possessing air source 40 such as blower and a valve is provided as the air vibration generating device 30, while the other construction is almost similar to the foregoing embodiment.

That is, as the air vibration generating device 30, an intake port 42 of the air source 40 such as blower and the valve 50 which is the oscillating device are connected with a tube 41, and the valve 50 is connected with a communication port 71 formed in a roof-shaped cover 70 for covering the opening of the upper part 2 of the removing apparatus main body 1, and the duct of the waveguide 60 is intermittently opened and closed by the valve 50, thereby feeding unidirectional pulsating waves toward the porous member 4 beneath cover 70. In this case, the waveforms of the air vibration waves are in corrugated waveforms in negative pressure state.

In this embodiment, the air source 40 acts in suction type, but it may also act in pressure feed type by replacing the intake port 42 with an exhaust port. The waveform of the air vibration waves may be freely changed.

In this embodiment, too, the deposit takeout means 7 as shown in FIG. 1 may be fitted to the cover 70 or the side of the upper part case.

Figure 6:
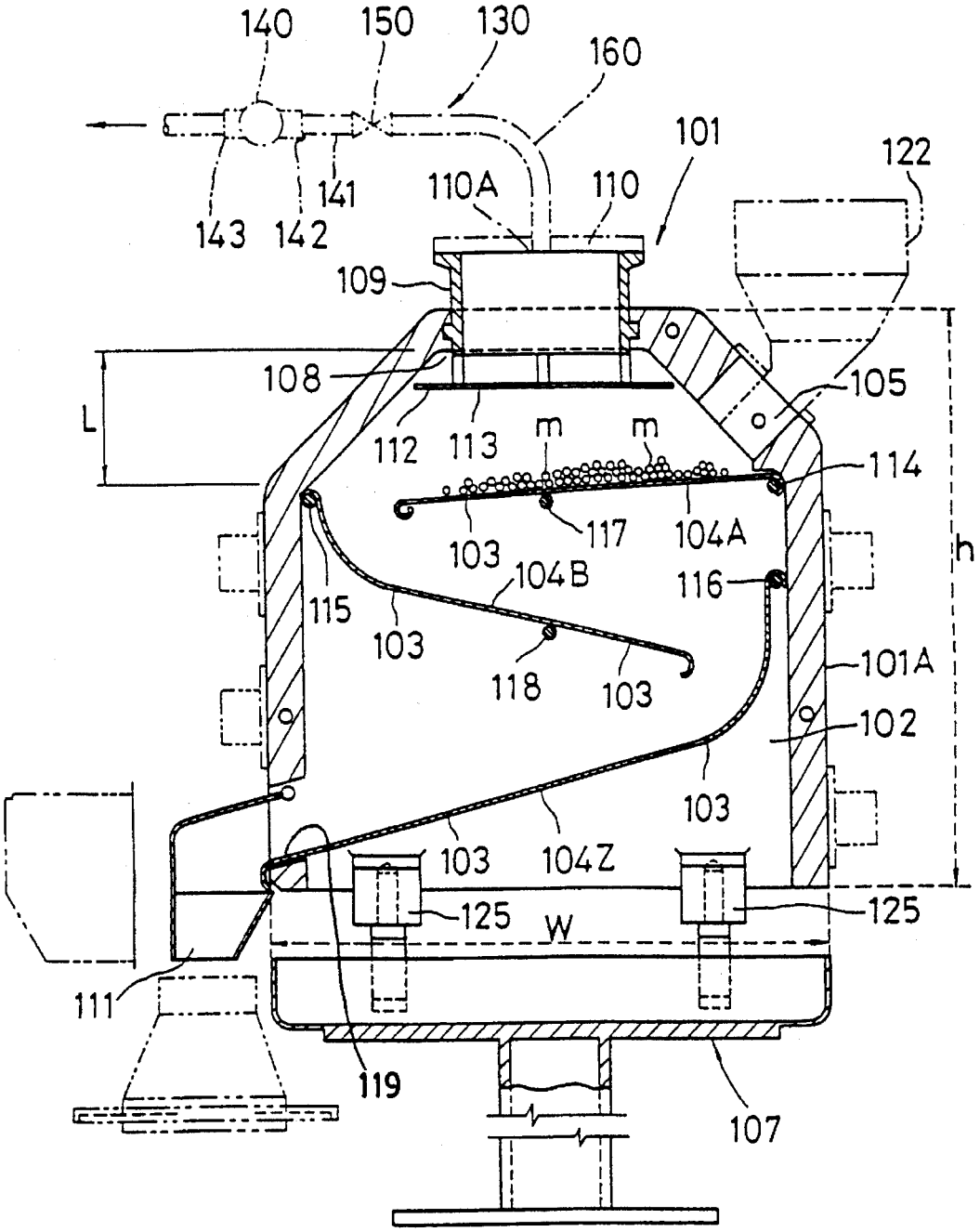
FIG. 6 is a longitudinal sectional view of essential parts in a third embodiment of the invention.
Figure 7:
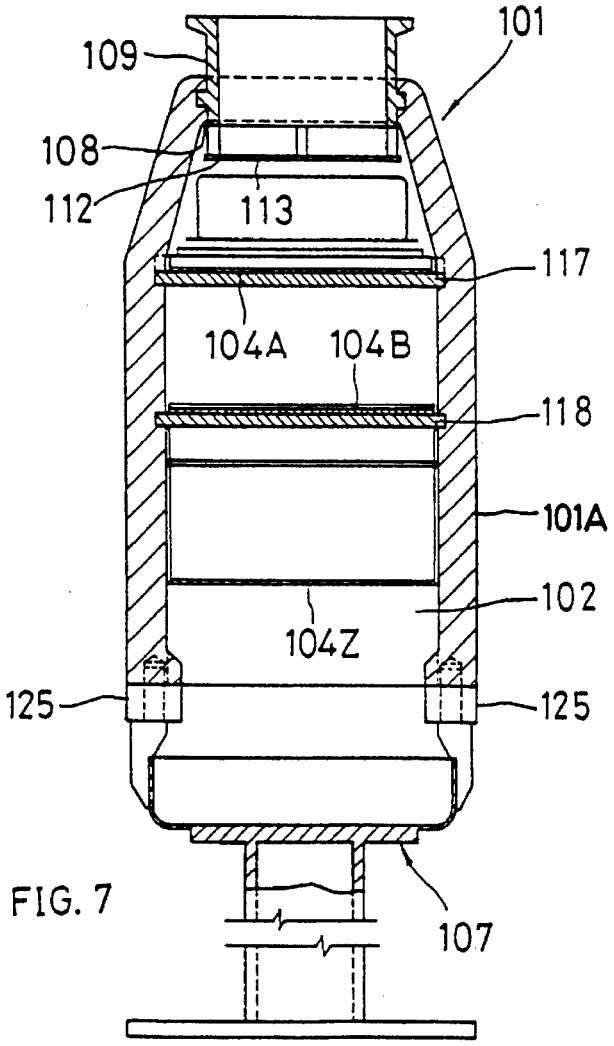
FIG. 7 is a central longitudinal sectional view omitting an air vibration generating device in FIG. 6.
Figure 8:
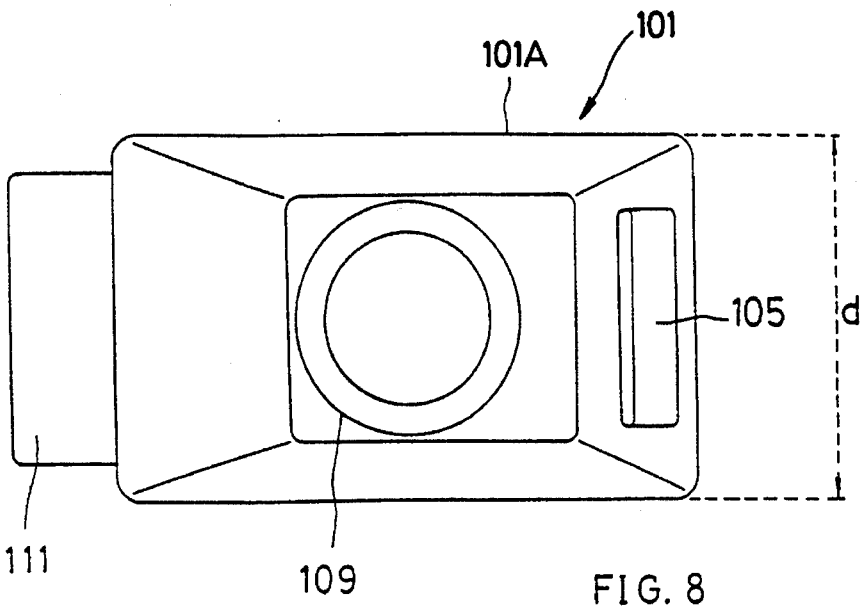
FIG. 8 is a plan omitting the air vibration generating device in FIG. 6.

An optimum third embodiment of the invention is shown in FIGS. 6 to 8.

FIG. 6 is a sectional view of essential parts of an apparatus for removing deposits, FIG. 7 is a central longitudinal sectional view omitting an air vibration generating device 130 in FIG. 6, and FIG. 8 is a plan omitting the air vibration generating device 130 in FIG. 6. This apparatus for removing deposits comprises a removing apparatus main body 101 possessing a feed port 105 above a first porous member 104A stretched laterally in a main body case 101A formed tubularly in a decapitated pyramidal form, and a product outlet 111 in the lower part thereof, and an air vibration generating device 130 for supplying unidirectional pulsating air pulsating while flowing in one direction toward the first porous member 104A from above the porous member 104A, in which the removing apparatus main body 101 and the air vibration generating device 130 are installed separately from each other, and the pulsating air from the air vibration generating device 130 is supplied into the removing apparatus main body 101 through a waveguide 160. The porous member 104A can be vibrated by the unidirectional pulsating air.

In an empty compartment 102 of the main body case 101A there are provided in stairs the first porous members 104A, second porous member 104B and third porous member 104Z possessing multiple tiny holes 103 smaller than the particle size of the powdered or granular materials to be treated as shown in FIG. 6.

The porous members 104A, 104B, 104Z are inclined in the material feeding direction, and are disposed in different directions alternately from each other. The first porous member 104A is for directly receiving the materials supplied through the feed port 105, and is inclined by 2 to 3 degrees, and the second porous member 104B and third porous member 104Z are inclined about 15 degrees. But these angles are not limitative. The inclination angles of the porous members 104A, 104B, 104Z are defined smaller than the angle of repose for the materials to slide down, and are determined in consideration of the retention time for contact with the pulsating air for fluidizing the materials smoothly, the forward force for conveying the fluidized materials in the feed direction, the size of the main body case 101A, noise during deposit removal work, and other conditions.

In FIG. 6, numerals 114, 115, 116 are mounting shafts of the porous members 104A, 104B, 104Z, and 117 and 118 are defining bars which prevent the first and second porous members 104A, 104B from oscillating. The front end of the waveguide 160 is connected to a vibration wave feed tube 109 mounted on the upper opening 108 of the main body case 101A. At the lower end of the vibration wave feed tube 109, a porous plate 112 having multiple tiny holes 113 smaller than the particle size of the materials m is suspended so that the materials m supplied onto the first porous member 104A from the hopper 122 may not be sucked in by the air source 140 of the air vibration generating device 130.

The distance L between the lower end of the vibration wave feed tube 109 and the first porous member 104A should be as short as possible because the magnitude of the vibration wave may be smaller. According to the experiment by the present inventor, when the distance L is about 40 to 45 mm, the noise by sound wave was small and favorable results were obtained. Anyway, the distance L is variable with the shape of the main body case 101A, such as height, width and depth, and is not limited to the mentioned figures.

The air vibration generating device 130 is similar to the one shown in FIG. 5, and an intake port 142 of an air source 140 of suction type such as blower and a valve 150 which is an oscillating device are connected with a tube 141, and the valve 150 is connected with a communication port 110A formed on a lid 110 for covering the opening of the vibration wave feed tube 109 of the removing apparatus main body 101, the duct of the waveguide 160 is intermittently opened and closed by the valve 150, and unidirectional pulsating waves are supplied toward the first porous membranes 104A (second and third porous membranes 104B and 104Z) through the vibration wave feed tube 109. In this case, the waveform of the air vibration wave is corrugated in negative pressure state.

In the lower part of the empty compartment 102 in the main body case 101A, a dish-shaped deposit takeout means 107 is detachably fitted by a tightening piece 125 such as punching lock. Deposits of the materials removed by pulsating waves through porous members 104A . . . 104Z are collected in this deposit takeout means 107.

On the other hand, the materials m being rid of deposits are discharged outside from a material outlet 111.

Dust particles lower in specific gravity than the deposits are discharged to the air vibration generating device 130 through the vibration wave feed tube 109 and waveguide 160. In this case, an exhaust tube (not shown) may be branched off on the way of the waveguide 160 to collect dust from the exhaust tube.

Meanwhile, the porous members 104A, 104B, 104Z are not limited to three stages as disclosed in this embodiment, but may be constructed in two stages, four stages or others as desired.

The reason why the porous members are made to vibrate with unidirectional pulsating air in the present invention will be explained hereinafter based upon the accompanying drawings.

Namely, unidirectional pulsating air moving in one direction, i.e., in the direction of suction (the direction indicated by the arrow mark in FIG. 6), is produced with the action of the air source 104 of a suction type and the valve 150. During the period in which the pulsating air current flows upward, the porous members jump up by turning upward with the air current and this jumping up of the porous members causes the materials supplied to the top face of the porous members to jump upward. Next, during the period in which the flow of the pulsating fluid comes to a standstill, the porous members drop with their own weight before the material does while the material is still suspended in the air. Then, when the material drops, the frequency of the pulsating wave is already in the next period and the porous members jump up. The collision between the dropping material and the jumping up porous members at that time powerfully separates and peels the deposits adhering to the material.

In order to remove deposits from materials efficiently by the apparatus for removing deposits of the invention, it is required to satisfy the three conditions: 1. particles of materials m should be fluidized on the surface of porous member by turning upside down without being broken, 2. the deposit removal rate from materials m should be high, and 3. the noise level by air vibration wave should be lower than the allowable limit.

Figure 9:
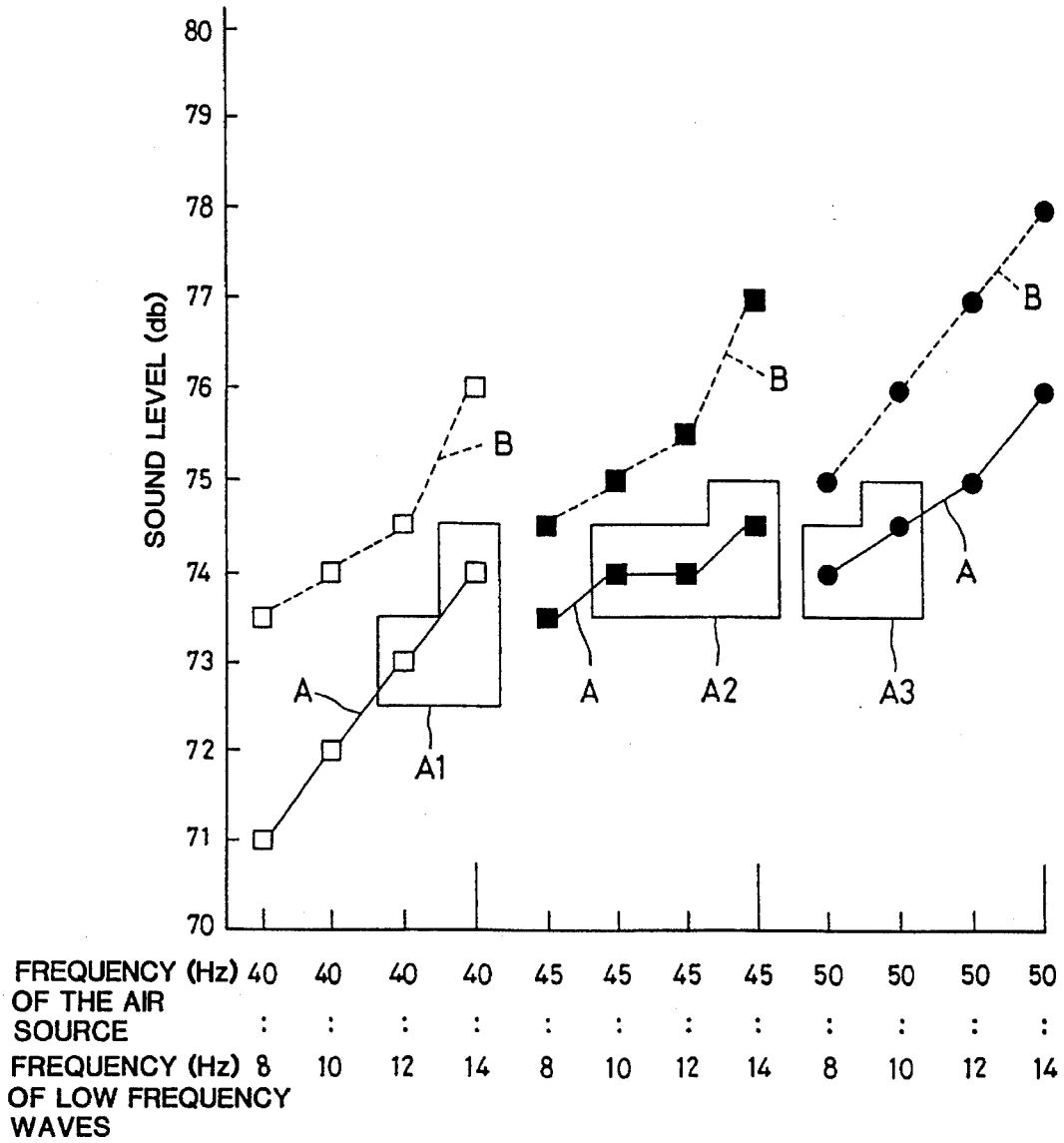
FIG. 9 is a graph showing the relation between frequency of air source and low frequency and noise level.
Figure 10:
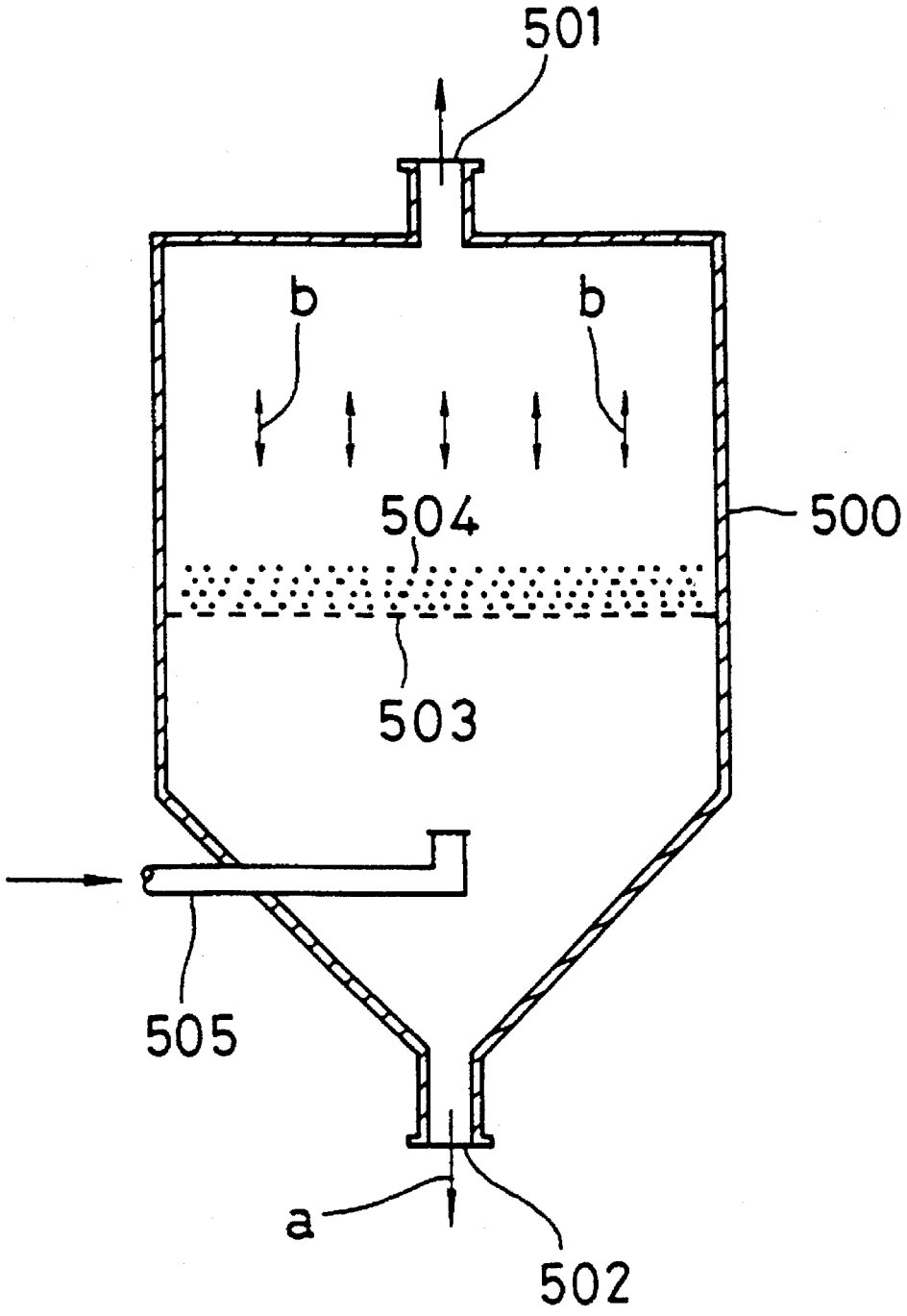
FIG. 10 is a longitudinal sectional view of a prior art .

On the basis of these conditions, the inventor experimented apparatus A and apparatus B, and obtained results as shown in FIG. 9.

(1) Apparatus A (FIGS. 6 through 8)

Height h is 168 mm, width w is 170 ram, depth d is 100 mm, and L is 45 mm.

Apparatus B

Width w and depth d are same as in apparatus A, L is 90 mm, and height h is 250 mm.

(2) Tablets were prepared as materials from which deposits are removed.

(3) In FIG. 9, using a ring blower as the air source 140, the frequency (Hz) of the air source 140 is plotted in the upper part of the axis of abscissas and the frequency (Hz) of low frequency waves (sound waves) in the lower part, and the noise level (db) is plotted on the axis of ordinates. Polygonal line A in FIG. 9 represents apparatus A of the invention, and polygonal line B denotes apparatus B, and blocks A1, A2, A3 satisfy the three conditions 1, 2, 3, showing the regions proved to be practical as the apparatus for removing deposits from materials. Polygonal B is found to be impracticable, not satisfying at least one of the three conditions 1, 2, 3, that is, the tablets cannot be fluidized, the deposit removal rate is low, or the noise level is over 75 db which is the allowable limit.

Incidentally, when composed so that the ionized air is vibrated and applied on the material surface, electrostatic deposits on the materials may be neutralized on the whole, and air vibration is applied at the same time, and hence the deposits may be removed effectively. This method and apparatus of removal may be applied, for example, in removal of deposits of semiconductor products or semifinished products in the semiconductor industry.

The invention is intended to remove deposits by air vibrations, and by properly changing the air pressure or air flow rate, the deposit peeling force from materials may be properly changed, and in the case of coated materials such as sugar-coated tablets, the quality may be guaranteed by preventing mixture of dust while protecting the surface.

We claim:

1. An apparatus for removing deposits comprising: a main body case forming the main body of the removing apparatus; a plural number of porous members disposed laterally in stairs in opposite directions alternately in the main body case; a feed port for material provided on the main body case above the porous member at the top, a product outlet provided at a lower part of the main body case; and an air vibration generating device for feeding unidirectional pulsating air pulsating while flowing in one direction toward said porous members from above said porous members, said air vibration generating device comprising an air source of a suction type, an oscillating device and a wave guide with a lower end of said wave guide communicating with an opening at a top of the main body so as to absorb an inside of the empty compartment of the main body case with a pulsating wave of suction air from above.

2. An apparatus for removing deposits as defined in claim 1, wherein a deposit take-out means is provided at the lower part of the removing apparatus main body.

3. An apparatus for removing deposits as defined in claim 1, wherein the waveform of the air pulsating wave supplied from the air vibration generating device is variable.

* * * * *

UNITED STATES PATENT AND TRADEMARK OFFICE

CERTIFICATE OF CORRECTION

PATENT NO. : 5,504,972

DATED : April 9, 1996

INVENTOR(S) : Hiroshi Tada, et al

It is certified that error appears in the above-identified patent and that said Letters Patent is hereby corrected as shown below:

ON THE TITLE PAGE:

Item [75] Inventors: Change "Hiroshi Tada; Yoshitaka Koishi; Yorinobu Takino, all of Hirakata; Matsui Osamu, Osaka; Kiyoshi Morimoto, Mishima; Yoshika Sanada, Shizuoka; Teiichi Miwa, Mishima; Kazue Murata, Hirakata, all of Japan", to --Hiroshi Tada; Yoshitaka Koishi; Yorinobu Takino, all of Hirakata; Osamu Matsui, Osaka; Kiyoshi Morimoto, Mishima; Yoshika Sanada, Shizuoka; Teiichi Miwa, Mishima; Kazue Murata, Hirakata, all of Japan--

Item [30] Foreign Application Priority Data:

Add --May 10, 1993 [JP] Japan ..... 5-144191--

Signed and Sealed this

Sixth Day of August, 1996

*Attest:*

Bruce Lehman

BRUCE LEHMAN

*Attesting Officer*

*Commissioner of Patents and Trademarks*